US005920919A

United States Patent [19]

Chang

[11] Patent Number: 5,920,919

[45] **Date of Patent: *Jul. 13, 1999**

[54] TOILET FLUSH SYSTEM

[76] Inventor: Shih-Chih Chang, deceased, late of Richland, Wash., by Kai-Chih W. Chang, legal representative

[ * ] Notice: This patent is subject to a terminal disclaimer.

[21] Appl. No.: 08/839,866

[22] Filed: Apr. 22, 1997

[51] Int. Cl.[6] ..... E03D 1/06

[52] U.S. Cl. ..... 4/378; 4/359

[58] Field of Search ..... 4/334, 335, 336, 4/354, 359, 362, 366, 367; 137/413, 414, 456, 461

[56] References Cited

U.S. PATENT DOCUMENTS

| | | | |
|---|---|---|---|
| 880,594 | 3/1908 | Stickdorn | 4/334 |
| 918,216 | 4/1909 | Stickdorn | 4/334 |
| 957,028 | 5/1910 | Bassett et al. | 4/334 |
| 985,952 | 3/1911 | Stickdorn | 4/334 |
| 2,854,994 | 10/1958 | Glasgow | 137/414 |
| 5,742,950 | 4/1998 | Chang | 4/334 |

*Primary Examiner*—David J. Walczak
*Attorney, Agent, or Firm*—Wells, St. John, Roberts, Gregory & Matkin, P.S.

[57] ABSTRACT

A toilet system which minimizes water usage, provides improved flushing,includes a water volume control device and provides flushing when the supply water pressure is below desired levels. The toilet system includes a source of water, a feed valve which is opened by an flush activation device and closes when the water supply flow rate falls below a predetermined flow rate. The toilet system also includes a sealed flush tank with a water volume control for pre-setting the desired water volume, and a flush valve which is activated when the flow rate of supply water falls below a pre-determined minimum level.

6 Claims, 5 Drawing Sheets

TOILET FLUSH SYSTEM

TECHNICAL FIELD

This invention generally pertains to an improved toilet flush system.

BACKGROUND OF THE INVENTION

Modern day toilets generally utilize an open flush tank to store a sufficient amount of water to provide the immediate flushing of the contents of the toilet bowl. When the activation lever or device is pushed, the water in the storage tank is released from the tank into the toilet bowl, which pushes the contents of the toilet bowl through the drain.

In the typical toilet, the flush valve closes when the tank water is nearly empty to isolate the open water storage tank and allow the tank to then refill with water to a pre-determined level. Most tanks utilize a float valve as an indicator of the pre-determined water level in the open water storage tank.

Most typical domestic toilets constantly maintain a level of water in the storage tank to have it continually available for the next flush. Maintaining a normally full storage tank causes several problems that have been recognized for many years. One of the more frequently occurring malfunctions in the typical toilet is that the water from the storage tank continuously leaks from the tank to the toilet bowl due to the difficulty in maintaining a good long term seal between the two over time.

Further, existing toilets utilize the elevational difference of the water in the storage tank to the elevation to the water in the toilet bowl to provide the pressure to achieve the flush.

The objects of this invention are therefore to provide a toilet system which:

A. Eliminates the need to provide water storage, and the problems associated therewith, between flushes;

B. Utilizes the existing pressure from the supply of water to provide the force to flush the toilet;

C. Minimizes the necessary water to accomplish a flushing of the toilet bowl and remove all the waste contained therein.

D. Includes both a control system to regulate the volume of water used in a flush combined with a low pressure flush means.

E. Can be flushed in situations in which the water supply cannot be supplied at normally acceptable or needed pressures.

F. Wherein the feed valve automatically closes when the feed water flowing through it falls below a predetermined minimum flow rate; and G. Wherein the flush valve is activated and discharges flush water into the toilet bowl when the flow rate of supply feed water falls below a predetermined minimum flow rate.

These objects are accomplished by providing a toilet system wherein the feed valve automatically closes, thereby blocking the supply feed water, when the feed water flowing through it falls below a pre-determined minimum flow rate. These objects are further accomplished by provided a normally empty flush tank which is sealed while it is being filled after the flush activation device is activated or engaged. When the activation device is engaged, supply water flows from the water supply into a closed and air tight storage tank where pressure builds as the storage tank is filled.

A volume control device is provided to stop the flow of supply water into the flush tank when a pre-determined volume of flow water has accumulated in the tank. Stopping the flow of water into the flush tank consequently stops the flow of water through the feed valve causing it to close.

The toilet system further accomplishes the objects in countries or areas where the supply water is not supplied at normally acceptable pressure levels, because the supply water accumulates in a sealed flush tank, where it compresses air. When the pressure in the flush tank interior reaches the pressure of the supply water, the flow of water will likewise stop, causing the feed valve to close and the flush valve to open.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

Figure 1:
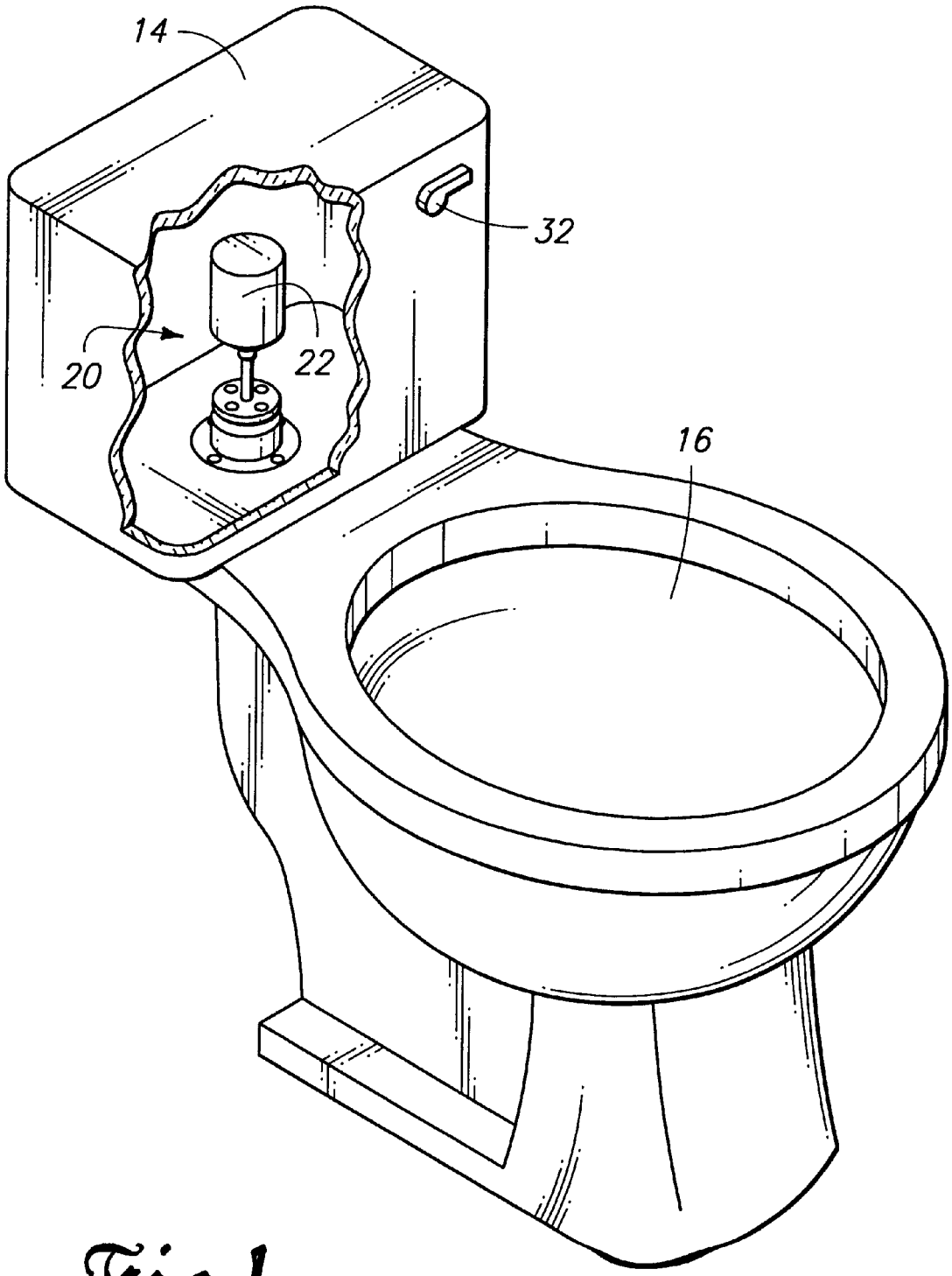
FIG. 1 is a frontal perspective view of a toilet with a flush tank and components of the invention contained therein.

The disclosure of the invention is submitted in furtherance of the constitutional purposes of the U.S. Patent Laws "to promote the progress of science and useful arts"(Article 1, Section 8).

Many of the fastening, connection, process and other means and components utilized in this invention are widely known and used in the field of the invention described, their exact nature or type is not necessary for an understanding and use of the invention by a person skilled in the art or science, and they will not therefore be discussed in significant detail. Furthermore, the various components shown or described herein for any specific application of this invention can be varied or altered as anticipated by this invention and the practice of a specific application of any element may already be widely known or used in the art or by persons skilled in the art or science and each will not therefore be discussed in significant detail.

This toilet system very generally consists of a source of water, a water supply feed valve or feed valve, a sealed flush tank, a flush valve, a flush volume control device and a toilet bowl.

The feed valve contemplated by this invention very generally is connected to the water supply and is utilized to start a flush cycle and to control the flow of supply water to the flush tank. The feed valve is opened by activating the flush activation device, thus allowing supply water to flow through it. The feed valve automatically closes when the supply water flowing through it falls below a pre-determined water flow rate.

The flush tank contemplated by this invention very generally is air tight, water tight and sealed from the atmosphere. The flush tank receives and temporarily stores flush water, along with the trapped air compressed by the introduction of flush water into the sealed flush tank.

The flush tank volume control device contemplated by this invention provides for stopping the flow of supply water when the water accumulated in the flush tank reaches a pre-determined minimum level.

The flush valve 80 contemplated by this invention generally activates and controls the flow of or discharge of water from the flush tank to the toilet bowl 16. The flush valve 80 is generally activated when the flow of water through the feed valve and into the flush tank falls below a pre-determined minimum level.

The toilet bowl can be any typical toilet bowl which receives waste and is disposed to receive flush water from the flush tank and to deposit its contents through a waste exit.

Very generally, the toilet flush system is initiated by the feed valve, which controls the feed water flow to the flush tank, the feed valve being normally closed. With the feed valve being normally closed, the flush tank is typically isolated from the supply of feed water. The feed valve contains an activation device which initiates the flush cycle. The actuation of the feed valve initiates the flush cycle and once the feed valve is actuated, it remains open, allowing feed water supply to flow, so long as a pre-determined volume of water flows through the valve. The feed valve closes automatically when the water flow through the valve is reduced to a predetermined low flow threshold.

The flush volume control device detects when the flush tank has been filled to the maximum desired water volume level, and then causes the water feed flow through the feed valve to diminish below the predetermined low flow threshold such that the feed valve closes and thereby cuts off or stops the water feed flow to the flush tank.

The flush valve is operatively located between the flush tank and the toilet bowl and generally controls the flow of flush water from the sealed flush tank to and through the toilet bowl. The flush valve closes when the feed water is flowing through the feed valve and into the flush tank, and conversely opens when the flow of feed water ceases. Thus, while the feed water is accumulating under pressure in the flush tank with compressed air, the flush valve remains closed, whereas when the flush tank has been filled to the desired level, the flush valve opens and discharges accumulated water to the toilet bowl. After a flush, the flush valve remains open between the flush tank and the toilet bowl and the flush tank therefore remains empty.

An additional feature of this invention is that since the opening of the flush valve is dependent upon the flow of feed water through the feed valve, when the flow ceases and even though the predetermined volume of water has not been reached within the flush tank, the flush valve is activated and opens. This feature allows the toilet system to flush even though there is insufficient feed water pressure to fill the flush tank to the predetermined volume level, an important feature when the feed water supply is variable or below normal acceptable levels.

The flush process contemplated by this invention is very generally defined in four operational modes, with variations thereto.

The first mode is the idle or non-use mode, during which the feed valve is closed and the water supply is isolated from the flush tank, the flush tank is empty and the flush valve is open.

The second mode is the feed or water supply mode, which is activated when the activation device is triggered. The triggering of the activation device opens the feed valve, which allows water to flow to the flush tank. In the feed mode, the flush valve is closed by pressure of the water flowing through the interior thereof between the feed valve and the flush tank. When the flush valve is closed, it maintains the seal of the flush tank. The feed water flowing into the flush tank therefore entraps and compresses the air that was previously occupying the tank and continuously accumulates in the flush tank until the flush valve opens. The flush valve will not open until either the predetermined water volume is reached or the flow of feed water from the feed valve ceases.

The third mode is the flow reduction mode, which occurs when water has accumulated to the predetermined level in the flush tank, and the volume control device is triggered to reduce or eliminate the feed flow below a predetermined minimum flow threshold.

The fourth mode is the flush mode and is initiated by the feed valve closing in reaction to the water feed flow falling below the predetermined level. With the water supply being stopped, water within the flush valve chamber leaks through the bleed hole, thereby decreasing the pressure holding the flush valve closed and the flush valve thereafter opens. The flush valve opens to allow the flow of water within the flush tank to the toilet bowl, discharging the water under pressure. The flush mode continues until the flush tank is empty and the flush valve remains thereafter open until the flush cycle is again activated. Once the flush mode is complete, the toilet system is and remains in the idle mode, ready for reactivation.

FIG. 1 illustrates a toilet configuration, including a toilet bowl 16, flush tank 14 with a flush tank interior 20, a flush activation device 32 and a volume control float 22.

Figure 2:
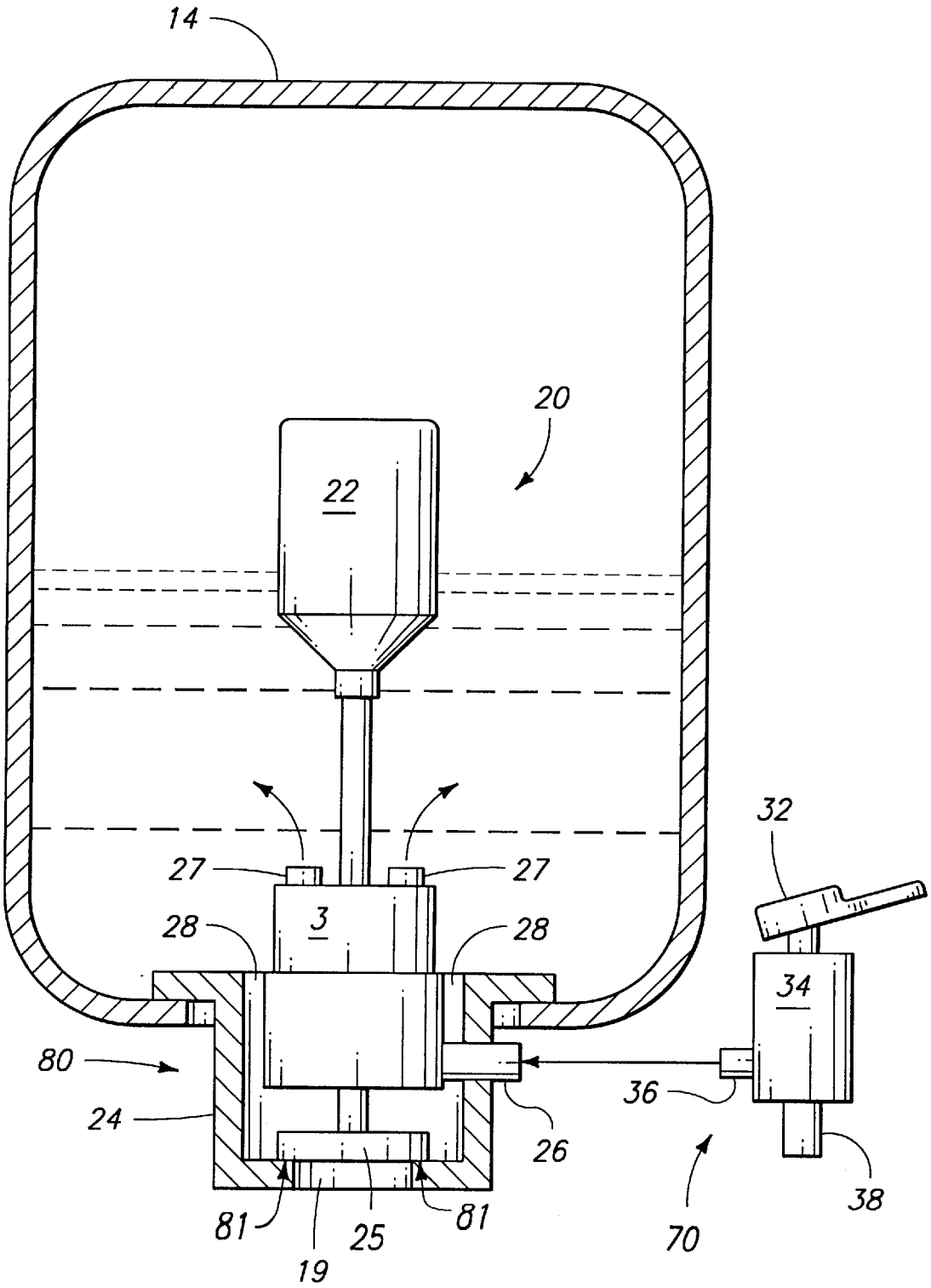
FIG. 2 is a internal side view from within one example of a flush tank contemplated by this invention.

FIG. 2 schematically illustrates a side view of a toilet system contemplated by the invention. FIG. 2 illustrates the relative relation of the feed valve 70, the flush tank 14, the flush valve 80 and the volume control system, including volume control float 22.

The feed water is supplied through inlet port 38 to feed valve 70, and when flush activation device 32 is depressed or activated, water exits feed valve 70 through water outlet port 36.

Flush water exits flush tank interior 20 through flush passageways 28 and when the flush valve 80 causes flush valve outlet plug 25 to retract, flush water exits through flush valve outlet 19. Flush valve outlet plug 25 is seated in flush valve outlet seat 81.

Figure 3:
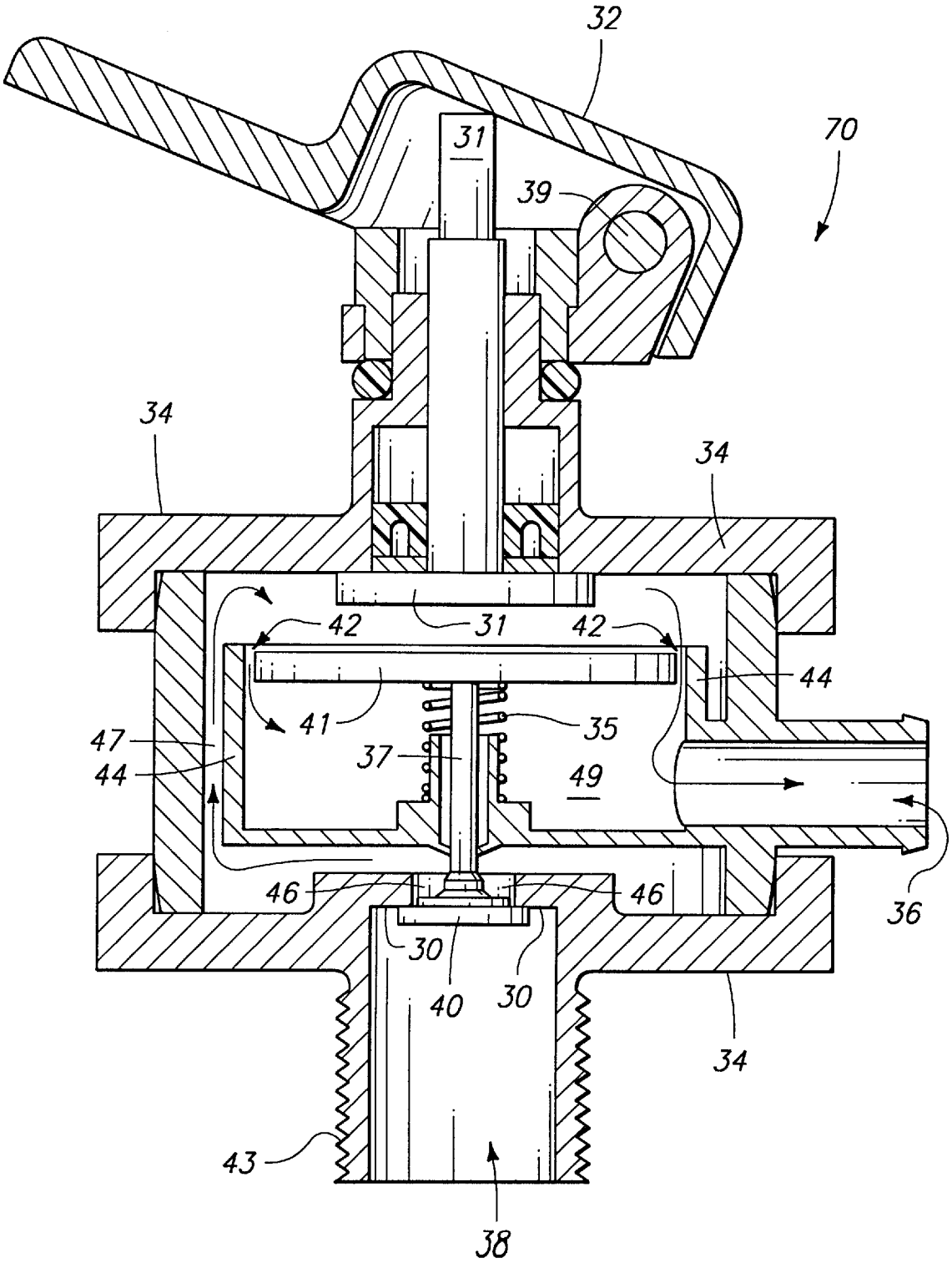
FIG. 3 is an example of one embodiment of a feed valve contemplated by this invention.

FIG. 3 illustrates one embodiment of the feed valve contemplated by this invention. The feed valve 70 contemplated by this invention is designed and configured to open when the flush activation device 32 is depressed or activated, and is designed and configured to close when the flow of the feed water from the water supply falls below a predetermined minimum flow rate.

The feed valve includes a feed valve flow sensor valve, which in the embodiment shown in FIG. 3, includes the inlet port plug 40, spring 35 and a water flow sensor 41, which is a disc 41, which imposes a drag force in the flow of the water, in the example shown.

Feed valve housing 34 supports these various components. Feed water inlet port 38 supplies feed water to the feed valve, which is prevented from entering the feed valve by a movable plug 40 until the flush activation device 32 is depressed. Depressing flush activation device 32 causes plunger 31 to force water flow sensor or disc 41 downward and consequently forces stem 37 and inlet port plug 40 to move downward. The movement of inlet port plug 40 into feed water inlet port 38 allows the pressurized feed water to flow past inlet port plug 40 and through passageway 46. Feed water flowing through inlet passageway 46 then proceeds through feed valve passageway 47 and into chamber 48.

Disc 41 is positioned within baffle 44 such that a drag gap 42 or passageway is provided between disc 41 and the respective sides of baffle 44. Water flowing into chamber 48 under pressure then flows through drag gap 42 and into feed valve exit chamber 49.

Spring 35 predisposes disc 41 to an extended position within baffle 44. The drag from feed water flowing through drag gap 42 on disc 41 causes the spring force from spring 35 to be overcome and disc 41 to be moved further into feed valve exit chamber 49. The movement of disc 41 consequently causes stem 37 and inlet port plug 40 to move into feed water inlet port 38, thereby maintaining the feed water inlet through passageway 46 open such that supply feed water can continue to flow so long as the pressure resulting from the drag of the feed water on disc 41 is sufficient to overcome the spring force exerted by spring 35.

Feed water passing through drag gap 42 and through feed valve exit chamber 49 then exits the feed valve through water outlet port 36, where it proceeds to flush tank interior 20.

The result of this design and configuration is that when the flow of feed water through chamber 48 and through drag gap 42 diminishes below a pre-determined level for any reason, the force exerted by spring 35 cannot be overcome and disc 41, stem 37 and consequently inlet port plug 40 are forced to the closed position by spring 35. Under low supply feed water pressure conditions, the flow through drag gap 42 and feed valve exit chamber 49 can diminish to the predetermined level by several different factors or forces, including: the pressure from supply feed water is insufficient to continue to fill the flush tank even though the predetermined volume of water has not been accumulated in flush tank 14; or the predetermined volume of water has been reached within flush tank 14 and the volume control system has cut off or reduced the flow of water into the flush tank 14. Regardless of the reason for the flow of feed water to flow below the predetermined level or to stop flowing altogether, the result is that spring 35 causes inlet port plug 40 to stop the flow of supply feed water through passageway 46 as inlet port plug 40 pushed against inlet port plug seat 30 effectively seals the supply feed water outside the feed valve and prevents its continued flow therethrough.

Figure 4:
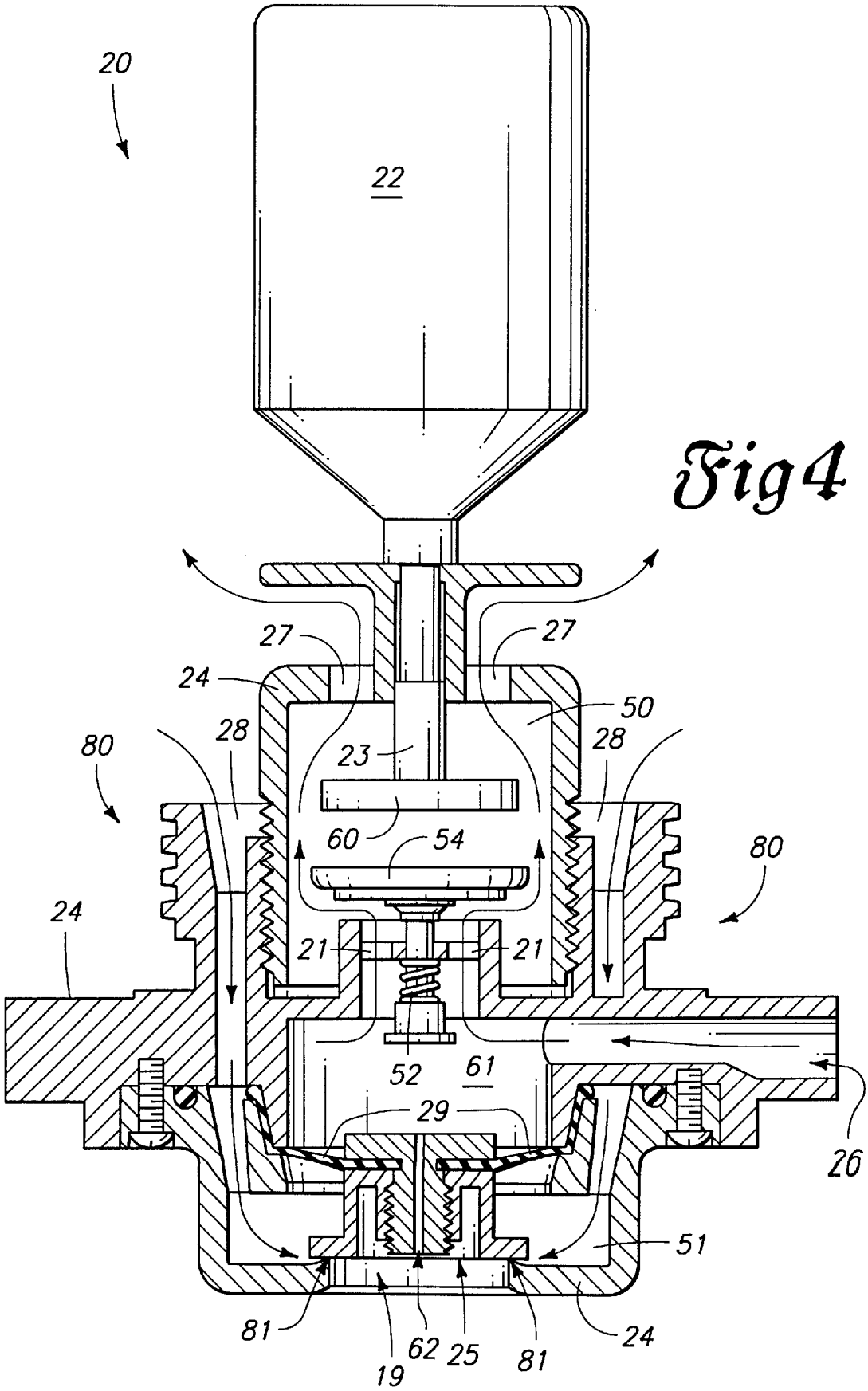
FIG. 4 illustrates one example of an embodiment contemplated by this invention, of the flush valve, flush tank water volume control device and related components, wherein the flush valve is in a closed position.

FIG. 4 shows the flush valve 80 in its closed position. Supply feed water enters through flush valve inlet 26, through passage 21, through chamber 50 and through flush tank inlet 27, and into the flush tank interior 20. As feed water flows into flush valve inlet 26 from the feed valve, it exerts pressure on flush valve outlet plug 25 and diaphragm 29 to push flush cover over flush valve outlet 19. Flush valve outlet plug 25 pushed against the perimeter of flush valve outlet 19, causes a seal and effectively closes the flush valve 80. Flush valve outlet plug 25 is seated in flush valve outlet seat 81, which provides the seal referred to above.

At the same time, the supply feed water overcomes the force exerted by spring 52, which holds plug 54 over passageway 21. Before the pressure from the supply feed water is introduced through passageway 21, spring 52 maintains plug 54 over passageway 21. Spring 52 can be at such a pressure so that before water can flow through passageway 21 and into the flush tank, it must reach sufficient pressure to force flush valve outlet plug 25 into flush valve outlet seat 81, thereby closing the flush valve 80.

Feed water flowing into chamber 50 then flows through flush tank inlet 27 to fill the flush tank interior 20. The flush tank interior 20 is otherwise sealed and full of air at the start of the flush cycle. The supply feed water entering flush tank interior 20 then begins to compress the air within flush tank interior 20 as it continues to flow. The supply feed water further causes volume control float 22, which is buoyant in water, to rise with the rising level of the water within flush tank interior 20. When the water level within flush tank interior 20 reaches a predetermined level, i.e. a predetermined flush volume, stem 23 causes volume control plug 60, which is attached thereto, to block flush tank inlet 27 and thereby cutoff or reduce the continued flow of feed water into flush tank interior 20. Once the predetermined volume level is reached in the flush tank interior 20 and volume control plug 60 blocks flush tank inlet 27, the flow of water into the flush tank ceases or is greatly reduced and the flow of water through feed valve 70 likewise ceases. Stopping the flow of water through feed valve 70 causes it to close and the flow of water through flush valve inlet 26 likewise ceases.

Flush passageways 28 provide a tank outlet for water from the flush tank interior 20 to flow through exit chamber 51 to be in a position to exit through flush valve outlet 19 once the pressure within exit chamber 51 exceeds the pressure within flush valve chamber 61.

Bleed hole 62 is provided through flush valve outlet plug 25 to relieve and reduce pressure from within flush valve chamber 61 to outside the flush valve chamber 61. Bleed hole 62 is preferably located through the flush valve outlet plug 25, which allows water to flow through bleed hole 62 and through the flush valve outlet 19 into the toilet bowl 16. If the feed valve 70 is closed and supply feed water is no longer flowing into flush valve chamber 61 to maintain pressure, the pressure within flush valve chamber 61 will continue to decrease as water flows through bleed hole 62 and the pressure from within flush tank interior 20 exerted through exit chamber 51 will push flush valve outlet plug 25 away from flush valve outlet 19 and allow the flush water within flush tank interior 20 to flow through flush valve outlet 19 and into the toilet bowl 16. Flush valve housing 24 supports these various components.

The volume control device shown in this embodiment of the invention is comprised of the volume control float 22, the volume control plug 60 attached to volume control float 22 by stem 23, and which slides through the volume control manifold 3.

Figure 5:
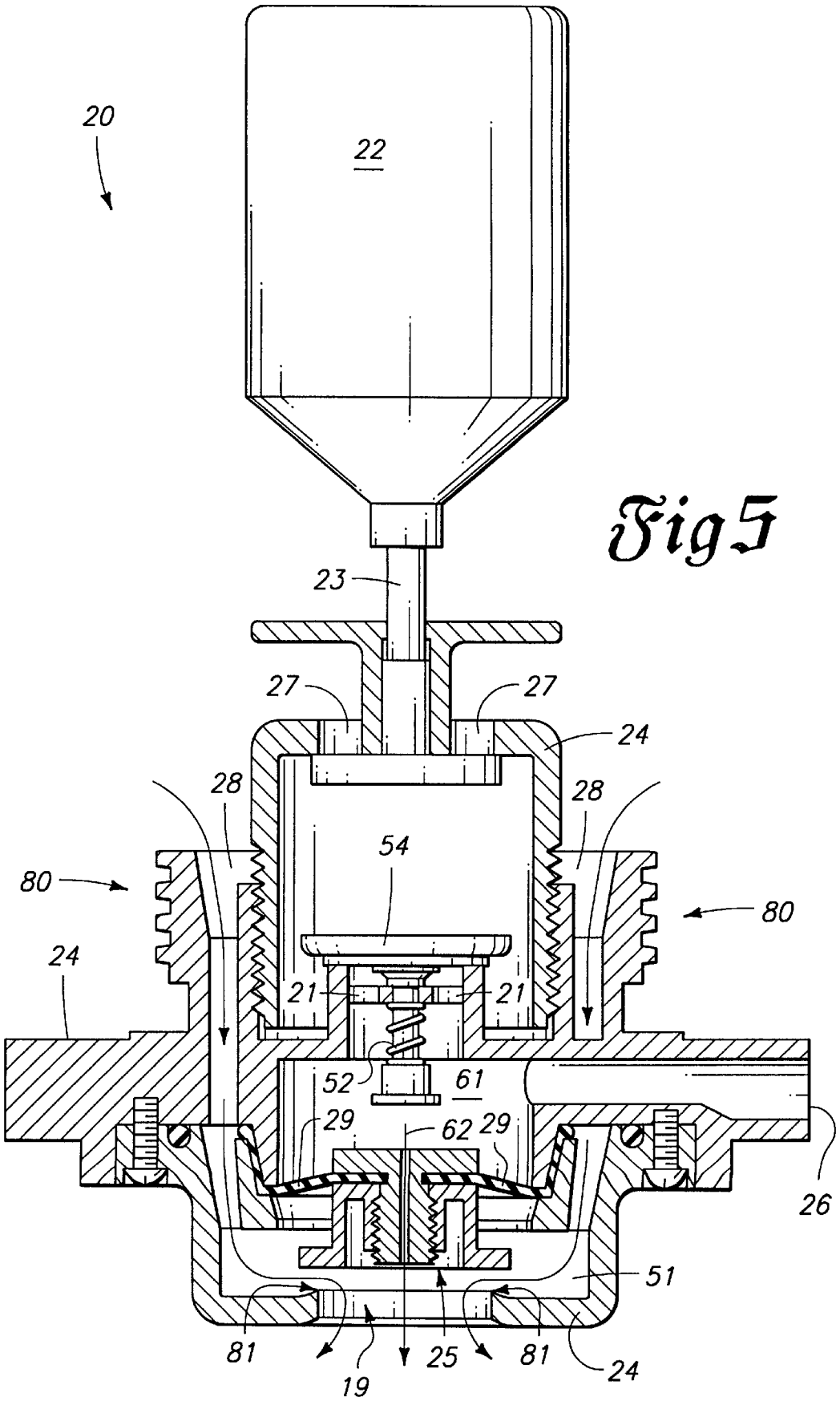
FIG. 5 illustrates one example of an embodiment contemplated by this invention, of the flush valve, flush tank water volume control device and related components, wherein the flush valve is in an open position.
Figure 3:
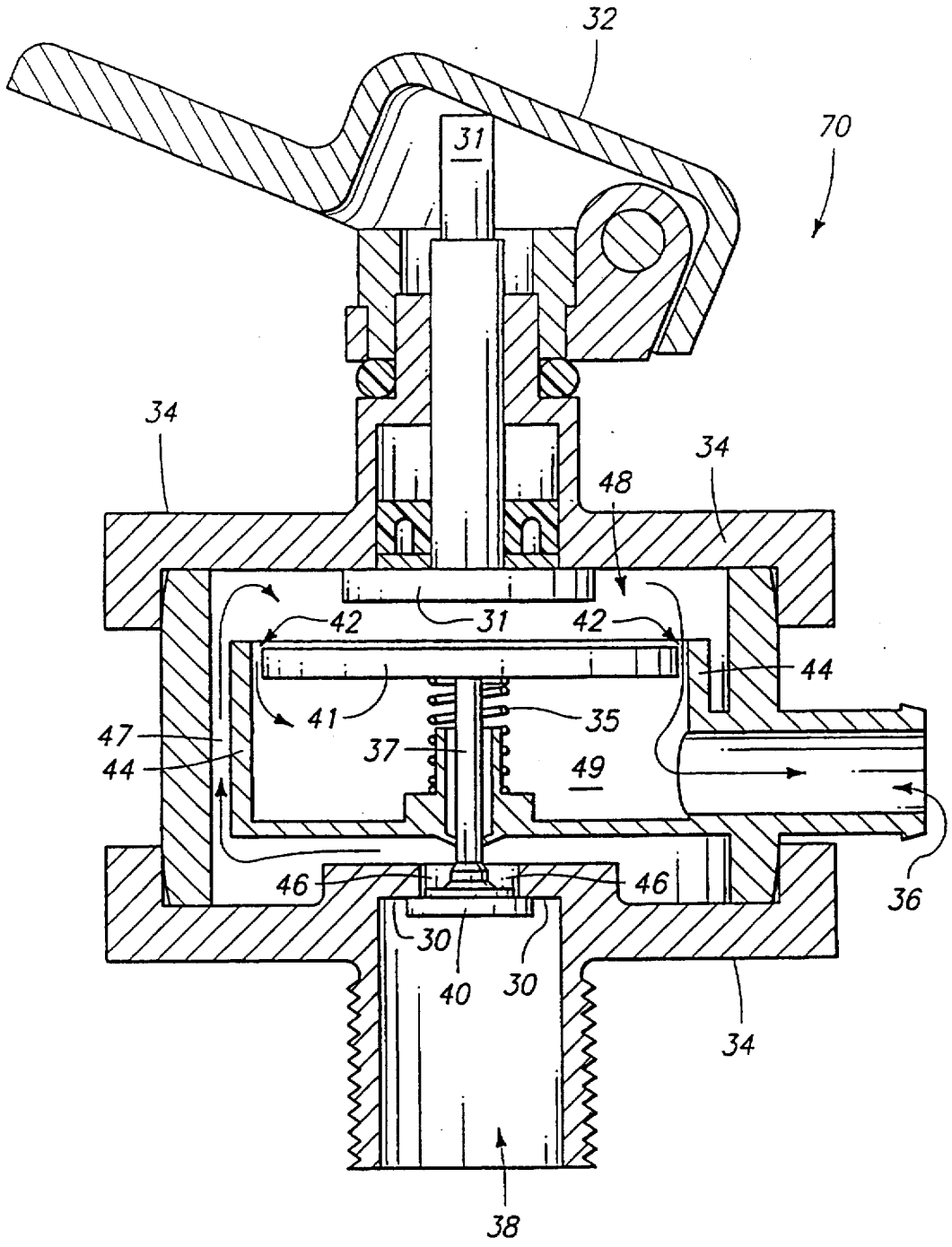

Once flush water flows through exit chamber 51, by flush valve outlet plug 25 and through flush valve outlet 19, flush valve outlet plug 25 remains in the upward position based on the elasticity of the diaphragm 29, as shown more fully in FIG. 5.

FIG. 5 illustrates the flush valve 80 as it reaches the initiation of the opening of the flush valve 80. The water within flush tank interior 20 has pushed volume control float 22 to its upper most position and volume control plug 60 is blocking flush tank inlet 27. The flow has thus been cutoff and the feed valve 70 closed. Since there is no additional supply feed water flowing, spring 52 pushes plug 54 over passageway 21 and the water flowing through bleed hole 62 has reduced the pressure within flush valve chamber 61 such that flush valve outlet plug 25 has been forced upward by the pressure of the flush water within exit chamber 51. As further shown in FIG. 5, water then flows from exit chamber 51 and from flush tank interior 20 through flush valve outlet 19, where it goes into the toilet bowl 16 and effectively removes the waste from the toilet bowl 16.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

It is claimed:

1. A toilet flush system, comprising:

a. a source of water;

b. a water supply feed valve in water-receiving relation to the source of water, and which includes a flush activation device which allows the flow of water through the feed valve when activated, and which closes when the flow of water falls below a predetermined level;

c. a flush tank with a flush tank inlet and a flush tank outlet, but otherwise being air tight and water tight, the flush tank inlet being disposed to receive water from the water supply feed valve;

d. a flush tank volume control device disposed to block the flow of water into the flush valve inlet once water in the flush tank reaches a pre-determined volume;

e. a flush valve comprised of:

i. a flush valve housing;

ii. a flush valve inlet in the flush valve housing, the flush valve inlet being in water receiving relation to the feed valve;

iii. a flush valve chamber, the flush valve chamber being disposed between the feed valve and the flush tank such that water flowing from the feed valve to the flush tank flows through the flush valve chamber;

iv. a flush valve outlet within the flush valve housing, including a flush valve outlet seat;

v. a flush valve outlet plug corresponding to the flush valve outlet seat, and which is (1) disposed between the flush valve inlet and the flush valve outlet such that pressure from the flush tank through the flush valve inlet exerts pressure on the flush valve outlet plug away from the flush valve outlet seat; and (2) disposed between the flush valve chamber and the flush valve outlet such that pressure from the flush valve chamber exerts pressure on the flush valve outlet plug toward the flush valve outlet seat; and vi. a water bleed hole providing a bleed hole from within the flush valve chamber to outside the flush valve chamber; and f. a toilet bowl in water receiving relation to the flush valve outlet, and which is operatively connected to a waste drain.

2. A toilet flush system as recited in claim 1, and in which the feed valve is further comprised of:

a. a feed valve housing;

b. the flush activation device operatively connected to the feed valve housing;

c. a water inlet port in the feed valve housing, in water-receiving relation to a source of water, and which includes an inlet port plug seat;

d. a water outlet port in the feed valve housing;

e. a water flow chamber in the feed valve housing in water-receiving relation to the water inlet port and in fluid communication with the water outlet port;

f. a flow sensor valve mounted within the feed valve housing, comprising:

i. an inlet port plug corresponding to the inlet port plug seat and disposed to block the flow of water through the water inlet port;

ii. a spring operatively connected to the inlet port plug and disposed to impart a force on the inlet port plug toward the inlet port plug seat, thereby plugging the water inlet port; and iii. the inlet port plug being disposed relative to the flush activation device such that activating the flush activation device overcomes the force the spring imparts on the inlet port plug, and moves the inlet port plug away from the inlet port plug seat, thus allowing the flow of water through the water inlet port;

iv. a water flow sensor operatively connected to the inlet port plug such that when water flows through the feed valve at a predetermined minimum flow rate, a force is exerted on the inlet port plug away from the inlet port plug seat, thus allowing water to continue to flow through the water inlet port.

3. A toilet flush system as recited in claim 1, and in which the volume control device is further comprised of:

a. a volume control float disposed within the flush tank;

b. a stem attached at a first end to the volume control float and attached at a second end to a volume control plug;

c. the volume control plug being disposed to block the flow of water to the flush tank when the volume control float is raised to a pre-determined level by water accumulating within the flush tank.

4. A water supply feed valve for use in combination with a toilet flush system, which is comprised of:

a. a feed valve housing;

b. a flush activation device operatively connected to the feed valve housing;

c. a water inlet port in the feed valve housing, in water-receiving relation to a source of water, and which includes an inlet port plug seat;

d. a water outlet port in the feed valve housing;

e. a water flow chamber in the feed valve housing in water-receiving relation to the water inlet port and in fluid communication with the water outlet port;

f. a flow sensor valve mounted within the feed valve housing, comprising:

i. an inlet port plug corresponding to the inlet port plug seat and disposed to block the flow of water through the water inlet port;

ii. a spring operatively connected to the inlet port plug and disposed to impart a force on the inlet port plug toward the inlet port plug seat, thereby plugging the water inlet port; and iii. the inlet port plug being disposed relative to the flush activation device such that activating the flush activation device overcomes the force the spring imparts on the inlet port plug, and moves the inlet port plug away from the inlet port plug seat, thus allowing the flow of water through the water inlet port;

iv. a water flow sensor operatively connected to the inlet port plug such that when water flows through the feed valve at a predetermined minimum flow rate, a force is exerted on the inlet port plug away from the inlet port plug seat, thus allowing water to continue to flow through the water inlet port.

5. A water supply feed valve as recited in claim 4, and in which the water flow sensor is further comprised of:

a. a water flow drag member attached to the inlet port plug, and disposed such that water flowing at a predetermined rate through the feed valve imposes a force on the water flow drag member, which in turn imparts a force on the inlet port plug away from the inlet port plug seat, the force exceeding the force imposed by the spring, thereby allowing the continued flow of water through the feed valve.

6. A toilet flush process, comprising the following steps:

a. providing a source of water;

b. providing a water supply feed valve comprised of:

i. a feed valve housing;

ii. a flush activation device operatively connected to the feed valve housing;

iii. a water inlet port in the feed valve housing, in water-receiving relation to a source of water, and which includes an inlet port plug seat;

iv. a water outlet port in the feed valve housing;

v. a water flow chamber in the feed valve housing in water-receiving relation to the water inlet port and in fluid communication with the water outlet port;

vi. a flow sensor valve mounted within the feed valve housing, comprising:

(1) an inlet port plug corresponding to the inlet port plug seat and disposed to block the flow of water through the water inlet port;

(2) a spring operatively connected to the inlet port plug and disposed to impart a force on the inlet port plug toward the inlet port plug seat, thereby plugging the water inlet port; and (3) the inlet port plug being disposed relative to the flush activation device such that activating the flush activation device overcomes the force the spring imparts on the inlet port plug, and moves the inlet port plug away from the inlet port plug seat, thus allowing the flow of water through the water inlet port;

(4) a water flow sensor operatively connected to the inlet port plug such that when water flows through the feed valve at a predetermined minimum flow rate, a force is exerted on the inlet port plug away from the inlet port plug seat, thus allowing water to continue to flow through the water inlet port in water-receiving relation to the source of water, and which includes a flush activation device which allows the flow of water through the feed valve when activated, and which closes when the flow of water falls below a predetermined level;

c. providing a flush tank with a flush valve inlet and a flush tank outlet, but otherwise being air tight and water tight, the flush valve inlet being disposed to receive water from the water supply feed valve;

d. providing a flush tank volume control device disposed to block the flow of water into the flush tank once water in the flush tank reaches a pre-determined volume;

e. providing a flush valve comprised of:

i. a flush valve housing;

ii. a flush valve inlet in the flush valve housing, the flush valve inlet being in water receiving relation to the flush tank outlet;

iii. a flush valve chamber, the flush valve chamber being disposed between the feed valve and the flush tank such that water flowing from the feed valve to the flush tank flows through the flush valve chamber;

iv. a flush valve outlet within the flush valve housing, including a flush valve outlet seat;

v. a flush valve outlet plug corresponding to the flush valve outlet seat (1) disposed between the flush valve inlet and the flush valve outlet such that pressure from the flush tank through the flush valve inlet exerts pressure on the flush valve outlet plug away from the flush valve outlet seat;

(2) disposed between the flush valve chamber and the flush valve outlet such that pressure from the flush valve chamber exerts pressure on the flush valve outlet plug toward the flush valve outlet seat; and vi. a water bleed hole in fluid communication with to water within the flush valve chamber to outside the flush valve chamber;

f. providing a toilet bowl in water receiving relation to the flush valve outlet, and which is operatively connected to a waste drain;

g. activating the flush activation device, thereby pushing the inlet port plug away from the inlet port plug seat and allowing water to flow through the water supply feed valve to the flush tank;

h. when the flush tank receives a pre-determined minimum volume of water, stopping the flow of water through the water supply feed valve; and i. bleeding water from within the flush valve chamber through the bleed hole, thereby causing the force on the flush valve plug from the flush tank through the flush valve inlet on the flush valve plug, to exceed the force imparted on the flush valve plug by the water in flush tank chamber, moving the flush valve plug away from the flush valve plug seat, and thereby allowing the water in the flush tank to flow through the flush valve and into the toilet bowl.

* * * * *

UNITED STATES PATENT AND TRADEMARK OFFICE

CERTIFICATE OF CORRECTION

PATENT NO. : 5,920,919
DATED : July 13, 1999
INVENTOR(S) : Shih-Chih Chang, deceased, by kai-Chih W. Chang It is certified that error appears in the above-identified patent and that said Letters Patent is hereby corrected as shown below:

Drawings:

Delete Drawing sheet 3 of 5 and substitute therefor Drawing sheet 3 of 5 as shown on the attached page.

Signed and Sealed this

Twenty-first Day of December, 1999

*Attest:*

Q. TODD DICKINSON

*Attesting Officer*

*Acting Commissioner of Patents and Trademarks*